US007725203B2

(12) United States Patent
Richards et al.

(10) Patent No.: US 7,725,203 B2
(45) Date of Patent: May 25, 2010

(54) ENHANCING PERCEPTIONS OF THE SENSORY CONTENT OF AUDIO AND AUDIO-VISUAL MEDIA

(76) Inventors: Robert Alan Richards, 191 University Blvd. #270, Denver, CO (US) 80206; Ernest Rafael Vega, 6519 Dieterle Crescent, Rego Park, NY (US) 11374

( * ) Notice: Subject to any disclaimer, the term of this patent is extended or adjusted under 35 U.S.C. 154(b) by 791 days.

(21) Appl. No.: 11/450,532

(22) Filed: Jun. 8, 2006

(65) Prior Publication Data

US 2006/0281403 A1 Dec. 14, 2006

Related U.S. Application Data

(60) Provisional application No. 60/688,874, filed on Jun. 9, 2005.

(51) Int. Cl.
*G06F 17/00* (2006.01)

(52) U.S. Cl. ..... 700/94

(58) Field of Classification Search ..... 700/94; 84/648, 659, 675, 692; 331/73
See application file for complete search history.

(56) References Cited

U.S. PATENT DOCUMENTS

| | | | | |
|---|---|---|---|---|
| 3,895,311 | A * | 7/1975 | Basse et al. | 331/1 A |
| RE30,278 | E * | 5/1980 | Stumpf et al. | 352/5 |
| 5,135,468 | A * | 8/1992 | Meissner | 600/28 |
| 5,289,438 | A * | 2/1994 | Gall | 369/4 |
| 6,052,336 | A * | 4/2000 | Lowrey, III | 367/139 |
| 6,229,899 | B1 | 5/2001 | Norris et al. | |
| 6,461,316 | B1 * | 10/2002 | Lee et al. | 601/46 |
| 6,661,285 | B1 | 12/2003 | Pompei et al. | |

(Continued)

FOREIGN PATENT DOCUMENTS

WO WO 03/044792 A1 * 5/2003

OTHER PUBLICATIONS

Roland Corporation, "Owner's Manual VS-2480 24bit/24track Digital Studio Workstation", 2001, Roland Corporation, pp. 1-452.*

(Continued)

*Primary Examiner*—Xu Mei
*Assistant Examiner*—Daniel R Sellers
(74) *Attorney, Agent, or Firm*—Brownstein Hyatt Farber Schreck, LLP; Ronald C. Gorsche

(57) ABSTRACT

The invention generally pertains to enhancing a sensory perception of media. More particularly, the invention pertains to creating a composition having at least one frequency in the ultrasonic or infrasonic range. By way of example, the composition is inaudible in its preferred embodiment, but audible components are contemplated. One aspect of the invention relates to selecting a root frequency and then, via a mathematical operation or algorithm, calculating a single component frequency or a plurality of frequencies that lie in the infrasonic or ultrasonic range. Typically, infrasonic and ultrasonic frequencies lie outside the range of hearing for the average human being. The ultrasonic or infrasonic component frequency is not heard, yet its presence and its tonal characteristics may enhance a perception of the sensory content of a media conveyed through a media device. Another aspect of the invention relates to encoding media with a composition having one or more calculated component frequencies such that, at least one of the component frequencies is less than 20 Hz or greater than 20 kHz.

36 Claims, 9 Drawing Sheets

U.S. PATENT DOCUMENTS

| | | | | |
|---|---|---|---|---|
| 6,689,947 | B2 | 2/2004 | Ludwig | |
| 6,694,817 | B2 | 2/2004 | Degertekin et al. | |
| 6,699,172 | B2 * | 3/2004 | Bologna | 600/13 |
| 6,770,042 | B2 | 8/2004 | Lee | |
| 6,771,785 | B2 | 8/2004 | Pompei | |
| 6,775,388 | B1 | 8/2004 | Pompei | |
| 6,914,991 | B1 | 7/2005 | Pompei | |
| 7,062,050 | B1 | 6/2006 | Pompei | |
| 7,079,659 | B1 * | 7/2006 | Oohashi et al. | 381/98 |
| 7,251,528 | B2 * | 7/2007 | Harold | 607/41 |
| 7,343,017 | B2 * | 3/2008 | Norris et al. | 381/77 |
| 7,391,872 | B2 | 6/2008 | Pompei | |

OTHER PUBLICATIONS

Harmony Central, "Boss OC-2 Octave", Dec. 5, 2004, The Web Archive, http://web.archive.org/web/20041205120504/www.harmony-central.com/Effects/Data/Boss/OC_2_Octave-01.html, pp. 1-41.* www.Contrabass.com, "Frequencies and Ranges", Apr. 5, 2001, The Web Archive, http://web.archive.org/web/20010405094253/http://www.contrabass.com/pages/frequency.html, pp. 1-6.*

Marchand Electronics Inc., "Audio Test CD", Jun. 18, 2004, The Web Archive, http://web.archive.org/web/20040618152925/http://www.marchandelec.com/sweeps.html, p. 1.* in70mm.com, "About Sensurround", Sep. 6, 2004, The Web Archive, http://web.archive.org/web/20040906140702/http://in70mm.com/newsletter/2004/69/sensurround/about.htm, pp. 1-11.*

"Infrasonic Experiment," Angliss, et al., www.spacedog.biz/infrasonic, U.K., Apr. 2003.

"Infrasonic Results," Angliss, et al., www.spacedog.biz/infrasonic, U.K., Apr. 2003.

"Sounds Like Terror in the Air," The Sydney Morning Herald, Australia, Sep. 9, 2003.

"Inaudible High-Frequency Sounds Affect Brain Activity: Hypersonic Effect," Oohashi,et al., The Am. Physiological Society © 2000.

* cited by examiner

ENHANCING PERCEPTIONS OF THE SENSORY CONTENT OF AUDIO AND AUDIO-VISUAL MEDIA

PRIORITY CLAIM UNDER 35 U.S.C. §119(e)

This application claims the benefit of U.S. Provisional Application no. 60/688,874, filed Jun. 9, 2005.

BACKGROUND OF THE INVENTION

1. Field of the Invention

Aspects of embodiments described herein apply to the sensory content of digital and non-digital audio and audio-visual media.

2. The Relevant Technology

Music, movies, video games, television shows, advertising, live events, and other media content rely on a mix of sensory content to attract, engage, and immerse an individual, audience, or spectators into the media presentation offerings. Increasingly, sensory content is electronically conveyed through speakers and screens, and uses a mix of audio and audio-visual means to produce sensory effects and perceptions, including visceral and emotional sensations and feelings.

Even where visual content and information is the main emphasis, audible content is often used to achieve desired effects and results. Theme parks, casinos, and hotels; shopping boutiques and malls; and sometimes even visual art displays use audible content to engage the audience or consumer. Some forms of media, like music and radio, are audio in nature.

By definition audible content is heard. Human hearing is sensitive in the frequency range of 20 Hz to 20 kHz, though this varies significantly based on multiple factors. For example, some individuals are only able to hear up to 16 kHz, while others are able to hear up to 22 kHz and even higher. Frequencies capable of being heard by humans are called audio, and are referred to as sonic. Frequencies higher than audio are referred to as ultrasonic or supersonic, while frequencies below audio are referred to as infrasonic or subsonic. For most people, audible content and media does not contain frequencies lower than 20 Hz or greater than 20 KHz, since the human ear is unable to hear such frequencies. The human ear is also not generally able to hear low volume or amplitude audio content even when it lies in the range of 20 Hz to 20 kHz.

Audio content is not only heard, it is also often emotionally and viscerally felt. This can also apply to inaudible content. Audio frequencies or tones of low amplitude, or audio frequencies and tones that fall outside the general hertz range of human hearing, can function to enhance sensory perceptions, including the perceptions of the sensory content of audio and audio-visual media.

It is therefore desirable to enhance perceptions of the sensory content of audio and audio-visual media using compositions that are inaudible in their preferred embodiments and are typically generated by infrasound and/or ultrasound component frequencies or tones. Such compositions may be matched to, and combined with, audible content or audio-visual content and conveyed to the end-user or audience through a wide variety of speaker systems. It is further desirable that such speaker systems function as a stand-alone system or be used in conjunction with, or integrated with, screens or other devices or visual displays.

BRIEF SUMMARY OF THE INVENTION

The invention pertains generally to method and apparatus for enhancing a sensory perception of audio and audio-visual media. More particularly, the invention pertains to creating a composition or compositions that have at least one component frequency in the ultrasonic or infrasonic range, and preferably at least two or more component frequencies in either or both the infrasonic and ultrasonic ranges. The composition is inaudible in its preferred embodiment, but audible frequency components are contemplated and are not outside the spirit and scope of the present invention. The components and compositions of the present invention may be embodied in multiple ways and forms for achieving their function of enhancing perception of sensory content. Different embodiments exist for matching or associating compositions to different productions and types of media content such as, for example, matching specific compositions to individual songs, movies, or video games, or to sections or scenes of these media productions. In another example, a component frequency or whole composition may be embodied as special effects that generate sensory effects, with the component(s) or composition functioning as musical output of an instrument or the like. Accordingly, musicians may find the present invention of particular importance for use in conjunction with any of the various devices or contrivances that can be used to produce musical tones or sounds.

One aspect of the invention relates to selecting a root frequency and then, via mathematical operations, calculating single or multiple component frequencies that lie in the infrasonic or ultrasonic range, and therefore outside the typical range of hearing for a human being. Typically, the component frequency is not heard, yet its presence and its tonal characteristics may be viscerally and emotionally felt. Any number of mathematical operations, operands or algorithms may be used, keeping in mind that coherency is a preferred factor in creating a dynamic coherent structure or system or systems based on linear or non-linear derivation of frequencies, and therefore coherence permeates throughout the description of the various embodiments even if not explicitly stated as such. Coherence, as that term is used to describe the present invention, means that a mathematical and/or numeric relationship exists throughout the compositions created according to the chosen mathematical operation or algorithm. However, given the ambiguities of discipline-based mathematical terms, it is also contemplated within the scope of this invention that incoherency may be a factor in the creation of components and their derived compositions.

Another aspect of the invention relates to encoding media with compositions generally having at least one infrasonic component frequency and one ultrasonic component frequency. In some instances, however, a component or components (if there are more than two components to start with) may be "subtracted out" to yield a single component composition in order to produce the desired sensory effect when matched to a specific media content. The remaining component frequency will be either infrasonic or ultrasonic.

Media, in the broadest sense, is defined and used to describe the present invention as content such as audio, audio/visual, satellite transmissions and Internet streaming content to name a few; media devices, for example, cell phones and PDAs; and media storage such as CDs, DVDs and similar products. It is contemplated and within the scope of this invention that direct calculation or derivation of a coherent component frequency generated by any ultrasonic frequency, infrasonic frequency, combination frequency, or other frequency or tonal characteristics associated with the illustrated invention are also part of the composition.

In another embodiment, a sound or music producer, director, engineer or artist could provide nuances and "flavoring" to their own products and properties using the compositions of the present invention. By giving them control over which components of the compositions they want to use—such as the particular tones and frequencies—they could customize their own products using a single component, or multiple components of one or more compositions.

Other aspects of the present invention will become readily apparent after reading the detailed description in conjunction with the appended claims.

BRIEF DESCRIPTION OF THE DRAWINGS

The present invention is illustrated by way of example and not limitation in the Figures of the accompanying drawings, in which like references indicate similar elements and in which.

DETAILED DESCRIPTION OF THE PREFERRED EMBODIMENTS

Figure 1:
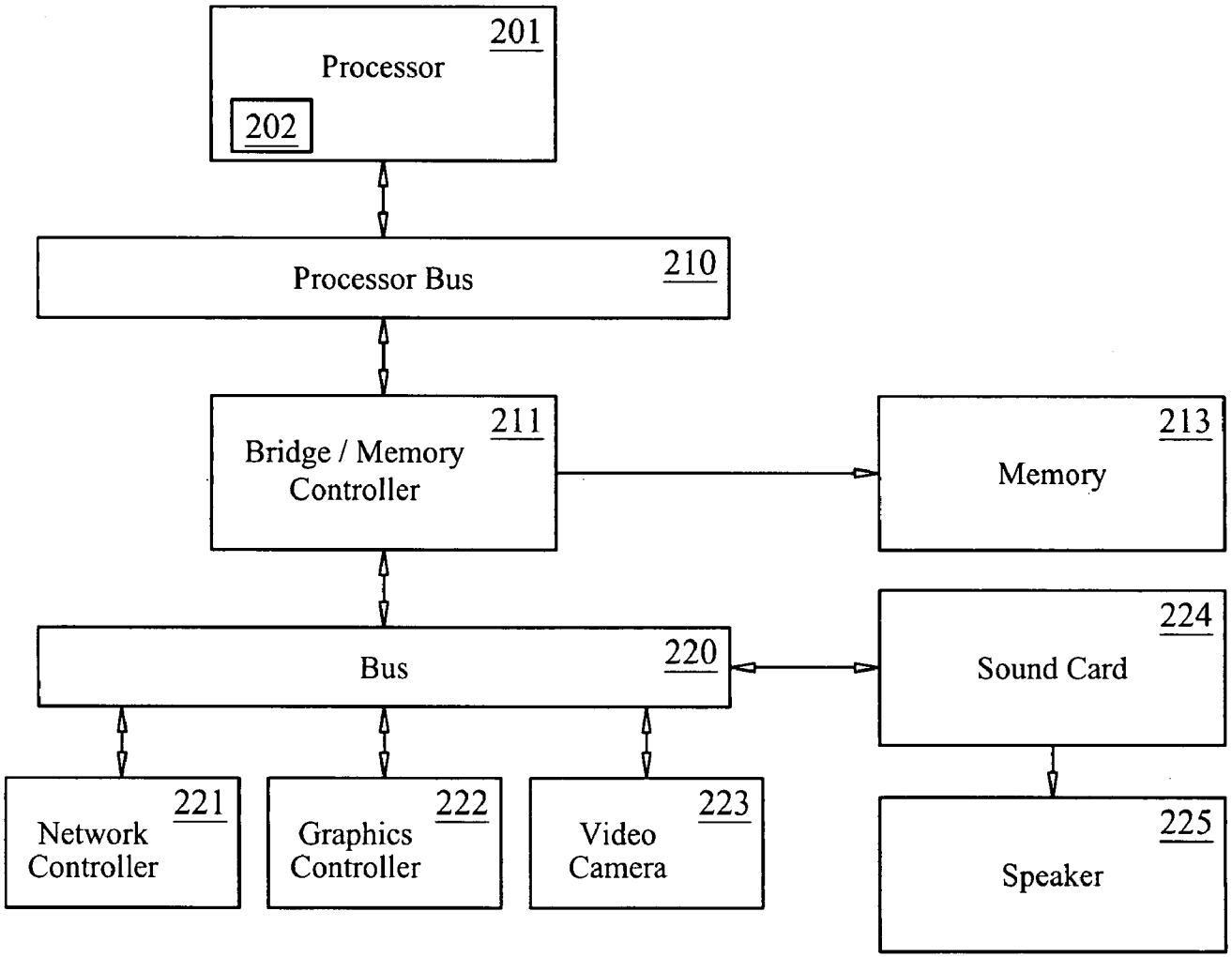
FIG. 1 illustrates an embodiment of a computing system that may be used in the present invention.

In the following description, numerous specific details are set forth, such as examples of specific media file formats, compositions, frequencies, components etc., in order to provide a thorough understanding of the present invention. It will be apparent, however, to one skilled in the art that the present invention may be practiced without these specific details. In other instances, well known components or methods have not been described in detail but rather in a block diagram in order to avoid unnecessarily obscuring the present invention. Thus, the specific details set forth are merely exemplary. The specific details may be varied from and still be contemplated to be within the spirit and scope of the present invention.

Reference to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment.

Reference in the specification to "enhancing perceptions of sensory content ("eposc") composition" or "eposc compositions" means, in general, a result of the method using numeric systems whereby a composition is generated that comprises at least two component frequencies. Each component frequency is either an infrasonic or ultrasonic frequency. Preferably, a composition with two component frequencies has a first component frequency that is infrasonic and a second component frequency that is ultrasonic. However, an example where both frequencies are infrasonic or both frequencies are ultrasonic is not outside the scope of the invention. As used herein, a stream, collection or group of infrasonic and/or ultrasonic component frequencies form an eposc composition.

In one embodiment, a composition may be generated or determined by (1) selecting a root frequency; (2) calculating, using either linear or non-linear mathematical operations, a first component frequency from the root frequency; and (3) further calculating, using linear or non-linear mathematical operations that may or may not be the same as used in step 2, a second component frequency from the first component frequency, such that the first and second component frequencies are either an infrasonic or ultrasonic frequency. However, in other embodiments, a component frequency or frequencies may be subtracted from the composition when the heuristic process of matching a composition and/or its component frequencies to media content determines that one component frequency by itself in either the infrasonic or ultrasonic frequency range provides the desired enhanced perception of sensory content better than multiple component frequencies.

The eposc composition may be further adjusted by changing its decibel levels, periodicity, and/or by changing the characteristics of its wave or wave envelopes using, for example, flanging, echo, chorus, or reverb. An eposc composition is inaudible in its preferred embodiment, but one skilled in the art can appreciate that an eposc composition having an audible component or components is contemplated within the scope of the present invention.

It is also contemplated within the scope of this invention that direct calculation or derivation of the associated tonal characteristics generated by any ultrasonic frequency, infrasonic frequency or other frequency associated with this method including, but not limited to, linear and non-linear overtones, harmonics and tonal variances are also part of the eposc composition. "Tonal" describes any audible or inaudible features created by a component frequency, or interaction of component frequencies.

Reference in the specification to "enhance" is based on subjective human sensibilities, and is defined as improving or adding to the strength, worth, value, beauty, power, or some other desirable quality of perception, and also to increase the clarity, degree of detail, presence or other qualities of perception. "Perception" means the various degrees to which a human becomes aware of something through the senses. "Sensory" or "sensory effects" means the various degrees to which a human can hear, see, viscerally feel, emotionally feel, and imagine.

As used herein, "content" or "original content" means both audio and audio-visual entertainment and information including, but not limited to, music, movies, video games, video gambling machines, television shows, radio shows, theme parks, theatrical presentations, live shows and concerts; entertainments and information associated with cell phones, computers computer media players, portable media players, browsers, mobile and non-mobile applications software, web presentations and shows. Content or original content also includes, but is no way limited to, clips, white noise, pink noise, device sounds, ring tones, software sounds, and special effects including those interspersed with silence; as well as advertising, marketing presentations and events.

It is contemplated in the scope of this invention that "content" may also mean at least a portion of audio and audio-visual media that has been produced, stored, transmitted or played with an eposc composition. Thus, for example, a television or radio broadcast with one or more eposc compositions is content, as well as a CD, DVD, or HD-DVD that has both original content and eposc content, where at least a portion of the original content and the eposc content are played simultaneously.

As the term is used herein, "media" means any professional or amateur-enabled producing, recording, mixing, storing, transmitting, displaying, presenting and communicating any existing and future audio and audio-visual information and content; using any existing and future devices and technologies; including, but not limited to electronics, in that many existing devices or technologies use electronics and electronic systems as part of the audio and audio-visual making, sending, and receiving process, including many speakers and screens, to convey content to the end-user, audience or spectators. Media also means both digitized and non-digitized audio and audio-visual information and content.

"Speakers" mean any output devices used to convey both the eposc compositions that includes their derivative component frequency or frequencies and tonal characteristics, as well as the audible content. A "speaker" is a shorthand term for "loudspeaker," and is an apparatus that converts impulses including, but not limited to, electrical impulses into sound or frequency responses or into any impression that mimics the qualities or information of sound, or delivers frequencies sometimes associated with devices such as mechanical and non-mechanical transducers, non-acoustic technologies that perform the above enumerated conversions to name a few, and future technologies. In the specification, the necessity of output through speakers is made explicit in many of the embodiments described. When not made explicit, it is inferred.

Accordingly, any reference to "inaudible" or "inaudible content" means any audio signal or stream whose frequencies are generally outside the range of 20 Hz to 20 kHz, or where the decibel level in the audible range is so low as to not be heard by typical human hearing. Hence, inaudible content are audio signals or streams that are generally less than 20 Hz and greater than 20 kHz, and/or are decibel levels in the normal range of human hearing. "Inaudible content" may also refer to the eposc compositions, inaudible in their preferred embodiments, calculated using the methods of the illustrated invention described herein. "Audible content" is defined as any audio signals or streams whose frequency is generally within the range of 20 Hz to 20 kHz, bearing in mind that the range may span as low as 18 Hz and as high as 22 kHz for a small number of individuals.

It is contemplated that many different kinds and types of infrasonic and ultrasonic frequencies and tones fall within the scope of this invention and may be used as sources, including digital and non-digital sources.

It is also contemplated that data encryption, data compression techniques and equipment characteristics, including speaker characteristics, do not limit the description of the embodiments illustrated and described in the specification and the appended claims.

Some portions of the detailed descriptions that follow are presented in terms of algorithms and symbolic representations of operations on data bits within a computer memory. These algorithmic descriptions and representations are the means used by those skilled in the data processing arts to most effectively convey the substance of their work to others. In general terms, an algorithm is conceived to be a self-consistent sequence of steps leading to a desired result. The steps of an algorithm require physical manipulations of physical quantities. Usually, though not necessarily, these quantities take the form of electrical or magnetic signals capable of being stored, transferred, combined, compared and otherwise manipulated. It has proven convenient at times, principally for reasons of common usage, to refer to these signals as bits, values, elements, symbols, characters, terms, numbers or the like.

It should be borne in mind, however, that all of these and similar terms are to be associated with the appropriate physical quantities and are merely convenient labels applied to these quantities. Unless specifically stated otherwise as apparent from the following discussion, it is appreciated that throughout the description, discussions utilizing terms such as "processing" or "computing" or "calculating" or "determining" or "displaying" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices. It is further contemplated within the scope of this invention that calculations can also be done mentally, manually or using processes other than electronic.

The present invention also relates to one or more apparatus for performing the operations herein. This apparatus may be specially constructed for the required purposes, or it may comprise a general-purpose computer selectively activated or reconfigured by a computer program stored within the computer. Such a computer program may be stored in a machine readable storage medium, such as, for example, any type of disk including floppy disks, optical disks, CD-ROMs, magnetic-optical disks, read-only memories (ROMs), random access memories (RAMs), EPROMs, EEPROMs, magnetic or optical card, or any type of media suitable for storing electronic instructions and coupled to a computer system bus.

The algorithms and displays presented and described herein are not inherently related to any particular computer or other apparatus or apparatuses. Various general-purpose systems may be used with programs in accordance with the teachings, or it may prove convenient to construct more specialized apparatus to perform the required method steps. The required structure for a variety of these systems will become readily apparent from the description alone. In addition, the present invention is not described with reference to any particular programming language, and accordingly, a variety of programming languages may be used to implement the teachings of the illustrated invention.

FIG. 1 is a block diagram of one embodiment of a computing system 200. The computing system 200 includes a processor 201 that processes data signals. Processor 201 may be a complex instruction set computer (CISC) microprocessor, a reduced instruction set computing (RISC) microprocessor, a very long instruction word (VLIW) microprocessor, a processor implementing a combination of instruction sets, or other processor devices.

In one embodiment, processor 201 is a processor in the Pentium® family of processors including the Pentium® 4 family and mobile Pentium® and Pentium® 4 processors available from Intel Corporation. Alternatively, other processors may be used. FIG. 1 shows an example of a computing system 200 employing a single processor computer. However, one of ordinary skill in the art will appreciate that computer system 200 may be implemented using multiple processors.

Processor 201 is coupled to a processor bus 210. Processor bus 210 transmits data signals between processor 201 and other components in computer system 200. Computer system 200 also includes a memory 213. In one embodiment, memory 213 is a dynamic random access memory (DRAM) device. However, in other embodiments, memory 213 may be a static random access memory (SRAM) device, or other memory device. Memory 213 may store instructions and code represented by data signals that may be executed by processor 201. According to one embodiment, a cache memory 202 resides within processor 201 and stores data signals that are also stored in memory 213. Cache 202 speeds up memory accesses by processor 201 by taking advantage of its locality of access. In another embodiment, cache 202 resides external to processor 201.

Computer system 200 further comprises a bridge memory controller 211 coupled to processor bus 210 and memory 213. Bridge memory controller 211 directs data signals between processor 201, memory 213, and other components in computer system 200 and bridges the data signals between processor bus 210, memory 213, and a first input/output (I/O) bus 220. In one embodiment, I/O bus 220 may be a single bus or a combination of multiple buses.

A graphics controller 222 is also coupled to I/O bus 220. Graphics controller 222 allows coupling of a display device to computing system 200, and acts as an interface between the display device and computing system 200. In one embodiment, graphics controller 222 may be a color graphics adapter (CGA) card, an enhanced graphics adapter (EGA) card, an extended graphics array (XGA) card or other display device controller. The display device may be a television set, a computer monitor, a flat panel display or other display device. The display device receives data signals from processor 201 through display device controller 222 and displays the information and data signals to the user of computer system 200. A video camera 223 is also coupled to I/O bus 220.

A network controller 221 is coupled to I/O bus 220. Network controller 221 links computer system 200 to a network of computers (not shown in FIG. 1) and supports communication among the machines. According to one embodiment, network controller 221 enables computer system 200 to implement a software radio application via one or more wireless network protocols. A sound card 224 is also coupled to I/O Bus 220. Sound card 224 may act as an interface between computing system 220 and speaker 225. Sound card 225 is capable of receiving digital signals representing audio content. Sound card 225 may comprise one or more digital-to-audio (DA) processors capable of converting the digital signals or streams into analog signals or streams which may be pushed to analog external speaker 225. Sound card 225 may also allow digital signals or streams to pass directly through without any DA processing, such that external devices may receive the unaltered digital signal or stream. The signal or stream can be played through a system with speakers or some other frequency delivering technology (not shown).

Figure 2:
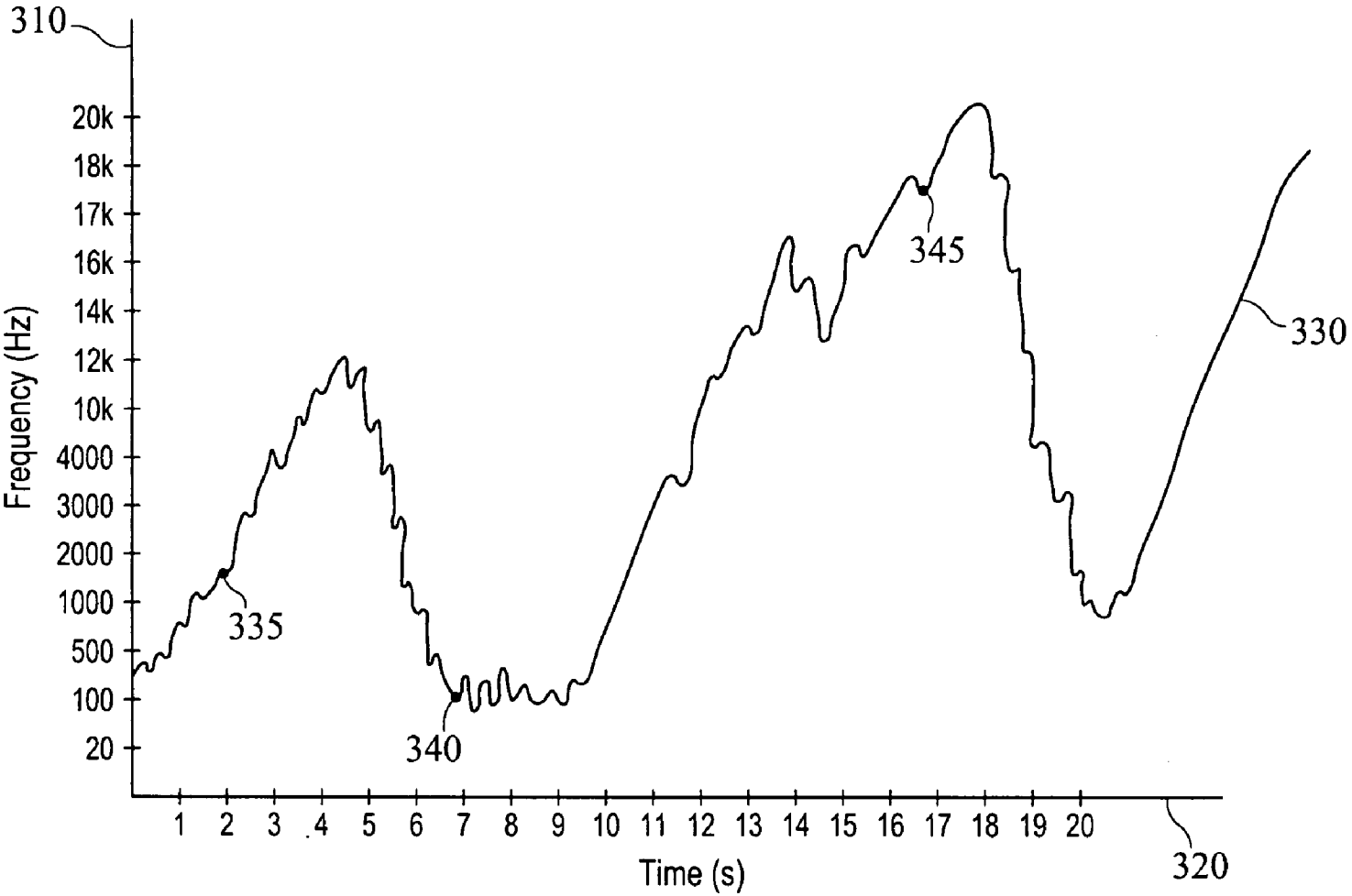
FIG. 2 illustrates an embodiment of a graphical representation of an audio signal.

FIG. 2 illustrates one embodiment of a graphical representation of an audio signal or stream. Graph 300 illustrates an audio signal represented by its frequency over time. The vertical axis 310 shows frequency in hertz. The horizontal axis 320 shows time in seconds. Curve 330 is the actual representation of the audio signal. Data point 335 illustrates that the audio signal or stream is playing a 1700 Hz tone two seconds into the stream. Data point 340 illustrates that the audio signal or stream is playing a 100 Hz tone seven seconds into the stream. Data point 345 illustrates that the audio signal is playing a 17500 Hz tone 17 seconds into the stream. In this embodiment, the entire audio signal or stream generates a frequency range between 300 Hz and 11,000 Hz which is audible by the human ear.

Figure 3:
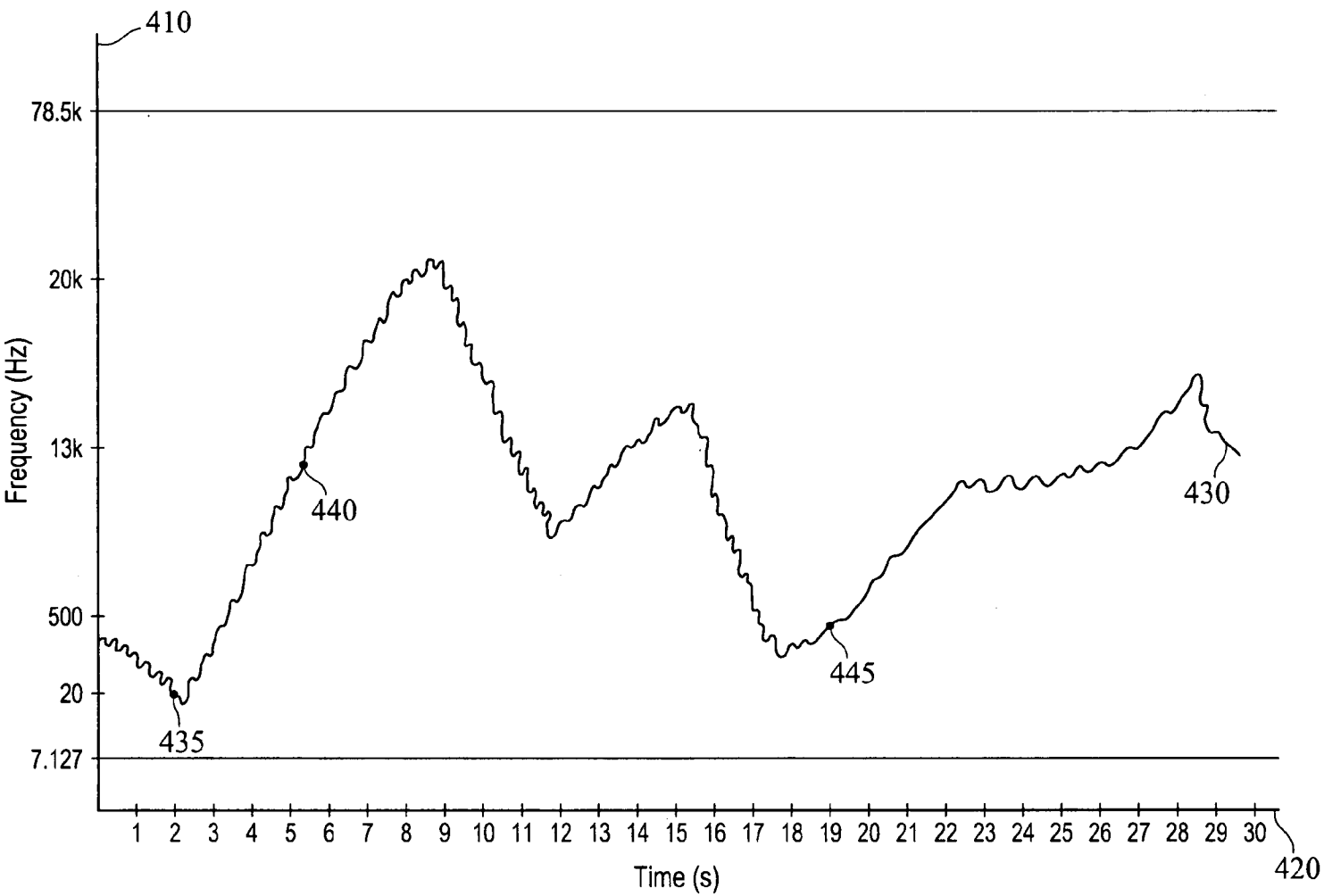
FIG. 3 illustrates another embodiment of a graphical representation of an audio signal with infrasonic and ultrasonic frequency tones added.

FIG. 3 illustrates a graphical representation of an audio signal or stream with both ultrasonic and infrasonic frequencies added to an audio signal. Graph 400 illustrates an audio signal represented by its frequency (y-axis) over time (x-axis). The vertical axis 410 represents a range of frequencies in hertz. The horizontal axis 420 represents the progression of time in seconds. Curve 430 is a representation of an audio signal. Data point 435 on curve 430 illustrates that the audio signal is playing a 21 Hz tone two seconds into the stream. Data point 440 on curve 430 shows that the audio signal is playing a 13,000 Hz tone six seconds into the stream. Continuing the illustrated example, data point 445 on curve 430 illustrates that the audio signal is playing a 500 Hz tone 20 seconds into the audio signal. In this embodiment, the primary audio signal generates a frequency range between 20 Hz and 13,000 Hz. This particular frequency range is audible by the human ear.

Graph 400 also shows an ultrasonic frequency 450. In the illustrated embodiment, frequency 450 is a linear 78,500 Hz tone. Such a frequency level is above and outside typical human hearing. However, such a frequency and its component frequency (not shown) may influence a sensory perception other than through hearing. Ultrasonic frequencies are frequencies that normally play above 20,000 Hz. In one embodiment, the component frequency of 78,500 Hz may resonate and affect certain portions of a human's perceptions while a person is concurrently listening to audio signal or stream 430.

Graph 400 illustrates infrasonic frequency 460. In this illustrated embodiment, frequency 460 is a linear 7.127 Hz tone. Similar to ultrasonic frequency 450, infrasonic frequency 460 is also beyond the level of typical human hearing. However, such a frequency and its tonal characteristics may influence a sensory perception by humans other than through hearing. As previously defined, infrasonic frequencies are frequencies that fall below 20 Hz. Such frequencies may induce visceral perceptions that can be felt in high-end audio systems or movie theaters. For example, an explosion may offer a number of frequency ranges well within human hearing (e.g. 20 Hz-20 kHz) as well as one or more infrasonic frequencies that are not heard but felt viscerally. Persons in the immediate area hear the audible explosion, while individuals further away may sense dishes shaking or windows rattling within their home. No sound may be heard, only the sensation of shaking as in an earthquake. This is the result of infrasonic frequencies at extremely high amplitudes. For example, 7.127 Hz may resonate certain portions of a human's visceral sense. The tone is not heard since it is outside the range of typical human hearing, yet its presence and its component frequency may be viscerally and emotionally felt while concurrently listening to, for example, audio signal 430.

Any combination of inaudible content may be added to audio signal 430, such as both ultrasonic and infrasonic frequencies or only infrasonic frequencies or only ultrasonic frequencies.

Infrasonic or ultrasonic frequencies may be added or encoded with audio signal 430 at varying levels of amplitude in order to heighten or decrease a sensory perception of an added tone. For example, an infrasonic frequency (not shown) may be encoded with audio signal 430 at 15 dB (decibels) below the reference level of the audio signal. For example, if an audio signal is played at 92 dB, the infrasonic frequency would be played at 77 dB. At some point later in the audio signal, the infrasonic frequency's amplitude may decrease to 25 dB below the reference level of the audio signal in order to modify its effects. At another point, the tone may increase to 10 dB below the reference level so as to modify the effects of the infrasonic or ultrasonic frequency.

In another embodiment, multiple linear ultrasonic frequencies may be added or encoded with audio signal 430 to create differing sensory effects that are typically inaudible to the human ear. For example, there may be four linear ultrasonic component frequencies of 20 kHz, 40 kHz, 80 kHz and 160 kHz added during audio signal 430. Each frequency may elicit varied sensory effects One or more nonlinear ultrasonic or infrasonic component frequencies may also be encoded with audio signal 430. For example, a single tone may be added that begins at 87,501 Hz and increases and decreases over time thereby varying the sensory effect during different portions of audio signal 430.

Figure 4:
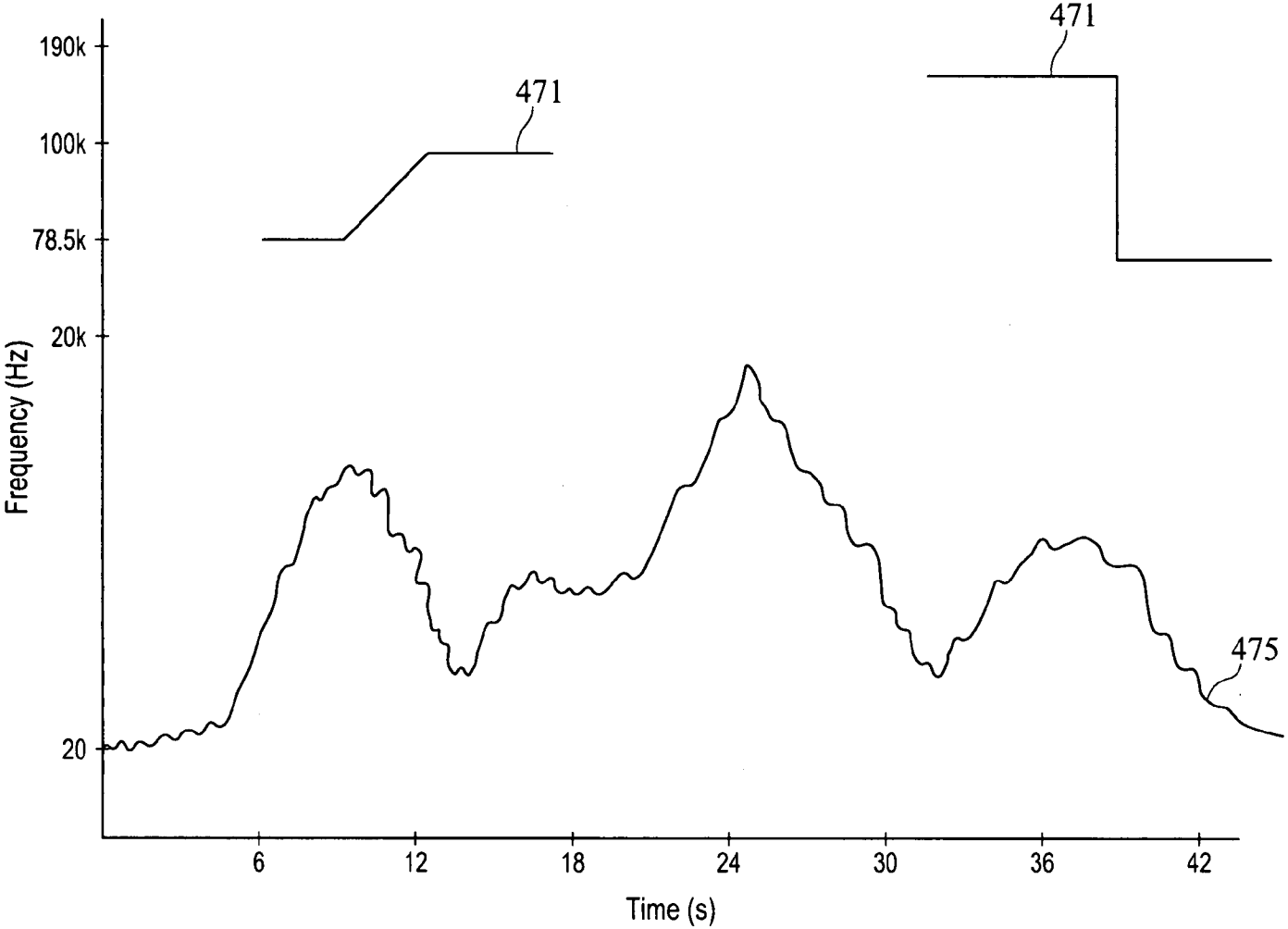
FIG. 4 illustrates another embodiment of a graphical representation of an audio signal with a variable periodicity ultrasonic frequency tone added.

FIG. 4 illustrates another embodiment having ultrasonic or infrasonic component frequencies added or encoded during a portion of an audio signal 430 such that its presence may fade in and out. Audio signal 475 exists within the audible human range of 20 Hz to 20 kHz. As illustrated, no ultrasonic or infrasonic component frequency tones exist at the start of audio signal 475. However, as shown, tone 471 is added six seconds into playback of audio signal 475. In the illustrated example, tone 471 is initially set at a frequency of 20 kHz. Tone 471 may last for 4 seconds and then increase to 40 kHz at a rate of 5 kHz per second. After 6 seconds of a constant 40 kHz, the tone may disappear for 12 seconds. Later, tone 471 may return at a frequency of 33.33 kHz for 9 seconds before dropping instantly to 54 kHz until the end of audio signal 475.

In another embodiment, multiple ultrasonic or infrasonic component frequencies may play concurrently alongside audio signal 430, with each tone fading in and out independent of the other. Further, each tone may have its own variable periodicity and hence its frequency may change over time. As an example, 15 separate ultrasonic frequency tones may be present for a time of 16 seconds in audio signal 475. However, for a time of 18 seconds, four of the tones may fade out, while six of the remaining tones may increase or decrease in frequency at a given rate of change.

Figure 5:
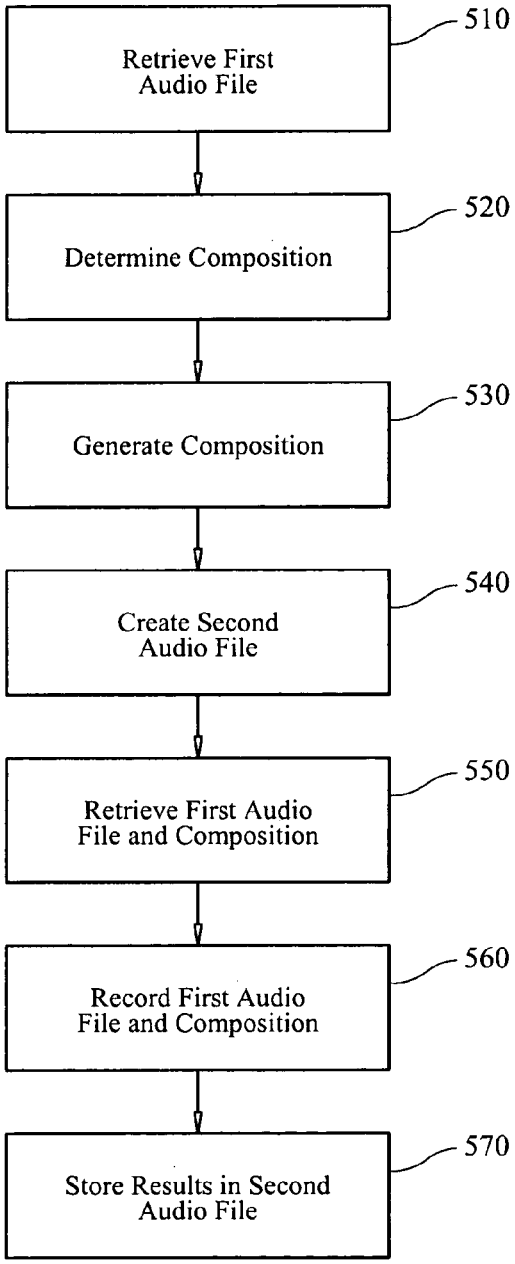
FIG. 5 illustrates an embodiment of a flow process of how an eposc composition of infrasonic and ultrasonic component frequencies may be added to audible content.

FIG. 5 illustrates an embodiment of a flow process of how an eposc composition may be added to or encoded with audible content including, for example, a sound recording. It is contemplated in the scope of this invention that the audible content of FIG. 5 may also have inaudible content. Accordingly, an eposc composition that is intended to be inaudible in its preferred embodiment can be added to inaudible content and further enhance any sensory content that may itself be inaudible. First, an audio file is received and stored in a first storage location 510. In one embodiment, the audio file is digital and does not require an analog to digital conversion before receipt. If such a file is received from an analog source, an analog to digital conversion may be required to transform the audio file into digital form. A means for receiving such a digital file may be by a computing system capable of handling digital content. Another means for receiving such a file may be by a hardware device such as an audio receiver, an audio pre-amplifier, audio signal processor, an external tone generator or a portable digital audio player such as an iPod made by Apple Computer. In one embodiment of this means, an audio file may reside on the same computing system or hardware device used to receive the file. Therefore, a user or process simply alerts the computing system or hardware device to the location of the audio file. In another embodiment of this means, the audio file may reside on a machine-readable medium external to the receiving device. The receiving device may have a wired input coupled to a wired output of the external machine readable medium, allowing a user to transmit the audio file to the receiving device through a wired connection. In another embodiment of this means, the audio or A/V file may reside on a machine readable storage medium that is connected to the receiving device through a computing network. The computing network may be a wired network using a TCP/IP transmission protocol or a wireless network using an 802.11 transmission protocol or some other transmission protocol to name a few illustrative examples. Such a means may allow a computing device to receive the audio file from a remote system over a hardwired or wireless network.

Once the audio file is received, it may be stored in a first storage location for later use. Examples of a machine readable storage medium used to both store and receive the audio file may include, but are not limited to, CD/DVD ROM, vinyl record, digital analog tape, cassette tape, computer hard drives, random access memory, read only memory and flash memory. The audio file may contain audio content in both a compressed format (e.g., MP3, MP4, Ogg Vorbis, AAC) or an uncompressed format (e.g., WAV, AIFF).

In one embodiment the audio content may be in standard stereo or 2 channel format, such as is common with music. In another embodiment the audio content may be in a multichannel format such as Dolby Pro-Logic, Dolby Digital, Dolby Digital-EX, DTS, DTS-ES or SDDS. In yet another embodiment, the audio content may be in the form of sound effects (e.g., gun shot, train, volcano eruption, etc). In another embodiment the audio content may be music comprised of instruments (electric or acoustic). In another embodiment the audio content may contain sound effects used during a video game such as the sound of footsteps, space ships flying overhead, imaginary monsters growling, etc. In another embodiment, the audio content may be in the form of a movie soundtrack including the musical score, sound effects and voice dialog.

An eposc composition 520 is then chosen for playback with the received audio file. In one example, an eposc composition may contain frequency tones of 1.1 Hz, 1.78 Hz, 2.88 Hz and 23,593 Hz.

Another means for determining how to implement an eposc composition is to select when to introduce, during playback or presentation of the audio or AN content file, an eposc composition. Certain portions of a song may elicit different sensory effects in a user or audience, such that one or more eposc compositions may be best suited for playback during certain portions of the audio file. For example, Franz Schubert's Symphony No. 1 in D has many subtle tones in the form of piano and flutes. A user may wish to add eposc compositions that are also subtle and are considered by that user to be consistent with, conducive to, or catalytic to the sensory effect he wants to experience. In contrast, Peter Tchaikovsky's 1812 Overture contains two sections with live Howitzer Cannons, numerous French horns and drums. These sections of the Overture are intense, powerful, and filled with impact. A user may choose to add an eposc composition to these sections that are consistent with, conducive to, or catalytic to strong, visceral feelings. Yet during other times of the Overture, such component frequencies or their composition may not be used. Therefore, the playback of an eposc composition or eposc compositions during the presentation may vary according to the type of sensory content being presented.

Other means for determining the characteristic of an eposc composition may include determining the volume level of the eposc composition. Generally, an eposc composition may be introduced at a lower decibel level than the associated content. In one embodiment, the volume level of the eposc composition is noted in reference to the volume level of the content. For example, it has been shown that the preferred volume level of an eposc composition is −33 dB, which means that the volume of the eposc composition is 33 decibels lower than the volume level of the associated content. In such an arrangement, irregardless of the volume level used for the playback of the eposc composition and the associated content, the eposc composition is always 33 decibels lower in decibel level than the content itself. For example, if the content is played back through head phones at 92 dB, the eposc composition is reproduced at 59 dB. If the playback of the content is changed to a concert level system at 127 dB, the eposc composition is changed to 94 dB.

In another embodiment, a user may determine a separate volume level for each eposc composition. As mentioned above, each volume level would be in reference to the content's volume level. For example, an eposc composition may have a frequency of 1.1 Hz with a volume of −33 dB, a frequency of 1.78 Hz with a volume of −27 dB and a frequency of 23,593 Hz with a volume of −22.7 dB.

As shown at step 530, the eposc composition is generated and stored in a storage location. A means for storing the eposc composition in a storage location may include any readable storage media as stated above. A means for generating the eposc composition may be software residing on a computing system. Any software application capable of generating specified frequency tones or eposc compositions over a given period of time may be used. The software should also be capable of controlling the volume level of each frequency within the eposc composition as well as the eposc composition as a whole. As stated above, the volume may be in reference to the volume level of the received content. An example of such a software application is Sound Forge by Sonic Foundry, Inc. Another means for generating an eposc composition may be an external tone generator and a recording device capable of capturing the tone.

At step 540, a second audio file is created. In one embodiment, the second audio file is an empty audio file that is configured for simultaneous playback of both the eposc composition and original content. A means for creating the second audio file is simply creating a blank audio file in one of many audio file formats as stated above.

Continuing with step 550, the first audio file and the generated eposc composition are retrieved from the first storage location and the second storage location. A means for retrieval may include the use of a computing system as described in FIG. 1. The eposc composition and first audio file may be loaded into the computing system's memory. Another means for retrieval may include the use of a software application such as Sound Forge where such an application allows for the direct retrieval and loading of multiple files into a computing system's memory. In such an embodiment, both files are readily accessible while residing in memory.

As illustrated at step 560, the first audio file and the eposc composition are simultaneously recorded into a combined audio file such that at least a first segment of the first audio file and a second segment of the eposc composition are capable of simultaneous playback. A means for recording the first audio file and the eposc composition are through the use of a computing system and a software application capable of mixing multiple audio tracks together. A software application such as Sound Forge is capable of mixing two or more audio files together, or in this example the original content and the eposc composition. Another means for recording the first audio file and the eposc composition is through the use of an external mixing board. Through such a means, an input from a mixing board may receive the original content and a second audio input from the mixing board may receive the eposc composition. Upon playback of both inputs, the mixing board may mix or merge both the original content and the eposc composition into a single output. From here, an external recording device may receive the combined file and record it onto a compatible storage medium. In one embodiment, the recording device is a computing system.

Continuing with step 570, the content and the eposc composition are stored into a second audio content file. A means for storing the combined audio content file into the second audio content file is through the use of a computing system and software. The second audio file was previously created as a blank audio file. Through the use of a computer, the contents of the combined audio file are saved into the blank second audio file.

Figure 6:
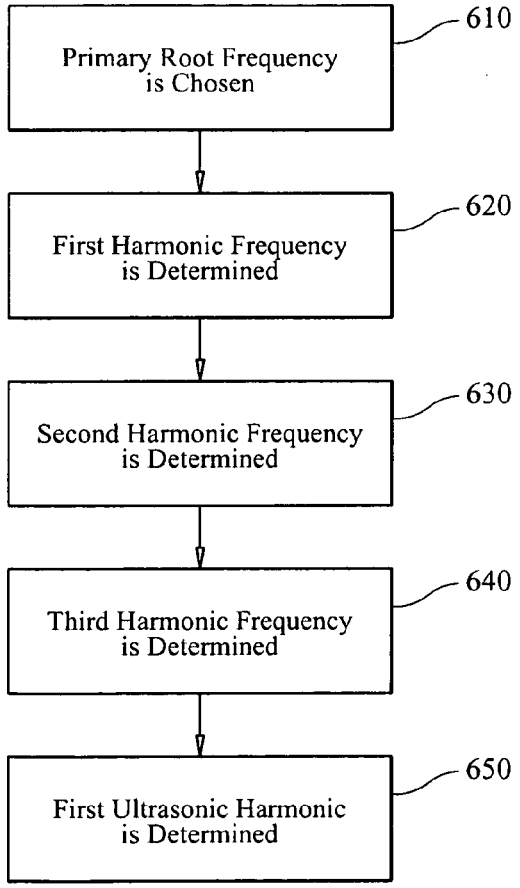
FIG. 6 illustrates an embodiment of how an eposc composition of ultrasonic and infrasonic component frequencies may be chosen for simultaneous playback with audible content.

FIG. 6 illustrates one embodiment of selecting and generating an eposc composition formed of ultrasonic and infrasonic component frequencies that may be selected and generated for playback with content, including music. Generally these frequencies are not chosen at random, but through the use of one or more formulae based on numeric systems. Different combinatorial patterns of component frequencies may be derived from these formulae based on numeric systems, thereby generating different compositions made of diverse component frequencies that provide different sensory effects when matched to media content.

Typically, the infrasonic and ultrasonic component frequencies utilized in the method and apparatus described herein are mathematically derived using linear and non-linear methods starting from a choice of a root frequency. In the illustrated embodiment, it is believed, but not confirmed, that in terms of ranking the preferences for choosing a root frequency, the primary choice for a root frequency is 144 MHz which works well with the invention described herein and provides a starting point for deriving components and, thereby, eposc compositions. Alternatively, a secondary choice for a root frequency could originate in the range from 0.1 MHz to 288 MHz, with 144 MHz being the approximate arithmetic mean, or median for this particular range.

Again alternatively, the tertiary choice for the root frequency could originate in the range from 1.5 kHz to 10 Petahertz. A quaternary choice for an alternative root frequency could originate anywhere in the range from 0 Hz to infinity, although generally the root frequency is identified and selected from one of the first three ranges because of their particular mathematical relationships to each other and to other systems.

Different mathematical methods may be employed to derive the actual infrasonic and ultrasonic component frequencies and their combinatorial properties.

At step 610, a primary root frequency is chosen. For the illustrated example of FIG. 6, 144 MHz ("R") is selected in the ultrasonic range. However one skilled in the art will appreciate that the root frequency may be alternatively chosen from the selection possibilities as illustrated above.

As shown in step 620, the first component frequency is calculated. In one embodiment, the first component frequency ("$C_1$" where the subscript number "1" designates the number in a series) is calculated by stepping down the root frequency a number of times until the result in within the infrasonic range. For example, the root frequency is stepped down 27 times. "Stepping down" is defined for purposes of the illustrated embodiment as dividing a number by two. Hence, stepping down the root frequency 27 times is equivalent to dividing 144,000,000 by two 27 times. The resulting value is 1.1 Hz, which places the first component frequency of the composition in the infrasonic range. Therefore 1.1 Hz is the first component frequency as well as the first infrasonic component frequency "$C_1IC_1$," where "IC" means infrasonic component.

One skilled in the art will understand that any numerical constant or mathematical function may be used to create a first component frequency from a chosen root frequency. The above example is for illustration purposes only, and it is readily apparent that there are many coherent mathematical methods and algorithms that may be used for deriving and calculating the first component frequency from a root frequency, and the illustrated embodiment is not meant to limit the invention in any way.

As illustrated in FIG. 6 at step 630, the second component frequency of the composition is calculated such that it falls in the infrasonic range ("$C_2IC_2$"). In the illustrated example, the second component frequency is calculated by multiplying the first component by Phi. In this example, Phi will be rounded to 1.6180. Illustrated mathematically, $C_2IC_2=(C_1IC_1*\text{Phi})$. For the example identified above, the second component frequency is 1.1*1.6180, or 1.78 Hz. Alternatively, but keeping within the scope and spirit of the present invention, the second component frequency ("$C_2IC_2$") can be multiplied or divided by Pi rounded to 3.1415 or phi rounded to 0.6180.

Continuing with step 640, the third component frequency is determined and is infrasonic. In the illustrated embodiment the third component frequency ("$C_3IC_3$") is calculated by adding the first component frequency $C_1IC_1$ to the second component frequency $C_2IC_2$. Mathematically represented, $C_3IC_3=C_1IC_1+C_2IC_2$. In this example, the third component frequency is 1.1+1.78, yielding 2.88 Hz ("$C_3IC_3$"). In another embodiment, the third component frequency of the composition could be calculated using a mathematical equation such as $(C_3IC_2*\text{Pi})/\text{Phi}$. It may be desirable that only component frequencies outside the range of human hearing are chosen for an eposc composition.

Continuing with the illustrated example of FIG. 6, a fourth component frequency is determined at step 650. In the illustrated example, the fourth component frequency is also the first ultrasonic component frequency ("$C_4UC_1$") and is calculated by stepping up the third component frequency ("$C_3IC_3$") until a value is in the ultrasonic range. "Stepping up" is defined for the illustrated embodiment as multiplying a number by two. The $13^{th}$ step (13 is the $8^{th}$ Fibonacci number) of 2.88 ("$C_3IC_3$") is 23,592.96 Hz. Hence, in the illustrated example, 23,592.96 Hz becomes the value of the fourth component frequency as well as the first ultrasonic component frequency ("$C_4UC_1$").

In alternative embodiments, additional ultrasonic component frequencies may be calculated utilizing the illustrated mathematical formulas as depicted above. For example, $C_4UC_1$ may be multiplied by Phi to create the fifth component frequency which is also the second ultrasonic component frequency ("$C_5UC_2$"). Additionally, a sixth component frequency, which is also the third ultrasonic component frequency ("$C_6UC_3$"), may be calculated by adding the first ultrasonic component frequency $C_4UC_1$ to the second ultrasonic component frequency $C_5UC_2$.

This illustrated example yields the following epocs composition made of the recited component frequencies (rounded): 1.1 Hz, 1.78 Hz, 2.88 Hz, 23,593 Hz, 38,173 Hz, and 61,766 Hz. For this embodiment, component frequency $C_1IC_3$ is recorded into an empty file at 0 dB, while the other five component frequencies are mixed into said file at −33 dB.

In another embodiment, the first component frequency may be derived from the primary choice for a root frequency, the second component frequency derived from either the primary or the secondary choice ranges for selecting a root frequency, and the third component frequency may be derived from a primary, secondary or tertiary choice range(s) for selecting a root frequency.

It should be appreciated by one skilled in the art upon examination of the above illustrated examples that any number of numeric systems and formulas may be used to select root frequencies and calculate their component frequencies. The above examples are intended to illustrate a preferred manner that has been shown to work as intended in accordance with the scope and spirit of the present invention and should not be construed to limit the invention in any way.

It should also be appreciated by one skilled in the art upon examination of the above illustrated examples that a heuristic process of matching any given composition to media content may also be part of the process of selection of a eposc composition. Each eposc composition may enhance perception of sensory content differently. Therefore subjective judgment is the final arbiter of any given eposc composition being ultimately associated with any individual piece of media content. Generally eposc compositions consist of at least two component frequencies with each component frequency being either infrasonic or ultrasonic, and in its preferred embodiment, a composition has at least one of each of infrasonic and ultrasonic frequencies. But one of these component frequencies may be subtracted from the composition to best match the composition to content, as long as the remaining component frequency is either infrasonic or ultrasonic.

FIGS. 7-10 consist of hardware devices capable of generating component frequencies and eposc compositions and concurrently playing them with content. These hardware devices are also capable of editing, adding and storing user-created eposc compositions for later playback.

Figure 7:
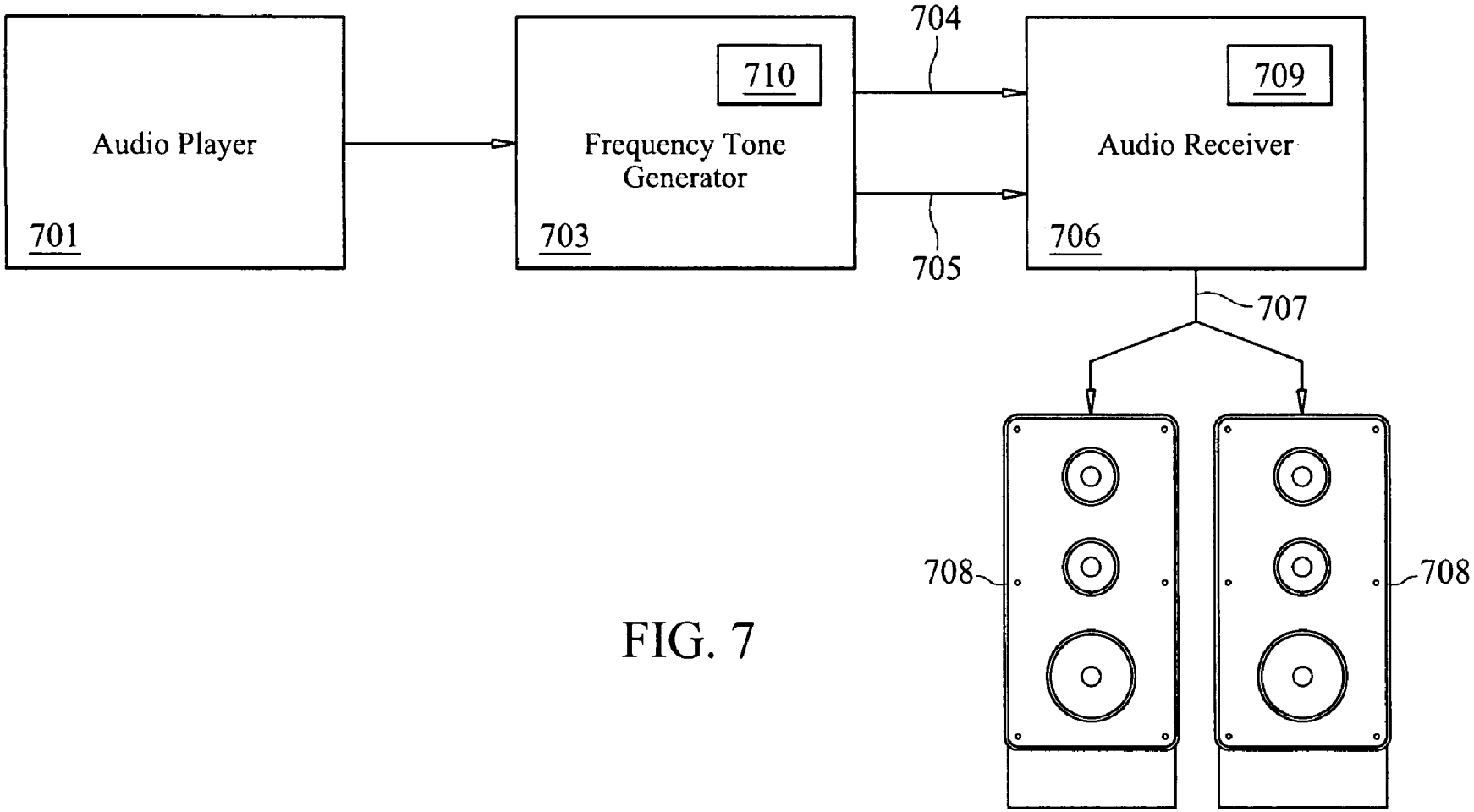
FIG. 7 illustrates an embodiment of a hardware device capable of generating ultrasonic and infrasonic component frequencies to be played concurrently with audible content.

FIG. 7 illustrates an embodiment of an external hardware device capable of generating an eposc composition to be played concurrently with audible content. Audio system 700 comprises an audio player 701, a Frequency Tone Generator 703, an audio receiver 706 and a pair of speakers 708. Audio player 701 is a device capable of reading digital or analog audio content from a readable storage medium such as a CD, DVD, vinyl record, or a digital audio file such as an .MP3 or .WAV file. Player 701 may be a CD/DVD player, an analog record player or a computer or portable music player capable of storing music as digital files to name a few examples. Upon playback of an audio signal, player 701 transmits the audio signal 702 to Tone Generator 703. Audio signal 702 may be a digital audio signal transmitted from player 701 which itself is a digital device, an analog signal that underwent a digital-to-analog conversion within player 701 or an analog signal that did not require a D-to-A conversion since player 701 is an analog device such as a vinyl record player to name a few.

Tone Generator 703, which is coupled to audio player 701, is capable of receiving signal 702 in either an analog or digital format. In one embodiment, Tone Generator 703 comprises separate audio inputs for both analog and digital signals. Typically, Tone Generator 703 may contain digital signal processor 710 which generates the ultrasonic and infrasonic component frequency tones. Alternatively, Tone Generator 703 may contain one or more physical knobs or sliders allowing a user to select desired frequencies to be generated by Tone Generator 703.

Tone Generator 703 may also have a touch screen, knobs or buttons to allow a user to select predefined categories of component frequencies that are cross-referenced to certain sensory effects. A predefined sensory effect can be selected by a user and concurrently generated during playback of audio content. For example, a display may include a menu offering 35 different named sensory effects or eposc compositions. Through manipulation of the display's touch screen and/or buttons, a user may choose one or more eposc compositions to be generated during playback of the audio content. Of the 35 different sensory effects, Sensory Effect 7 may be entitled "SE007." Sensory Effect 7 may be cross-referenced to a category of frequencies such as 1.1 Hz, 1.78 Hz, 2.88 Hz, and 23,593 Hz. Therefore, if a user selects "SE007", the above four component frequencies will be generated and played concurrently with the initially selected audio file received from audio player 701.

Tone Generator 703 may also allow manipulation of the volume level of each eposc composition. The volume level of each eposc composition may be in reference to the volume level of the audio file selected for playback. Hence a user my select how many decibels below the selected audio file's decibel level that the eposc composition should be played. Typically, the volume level of the eposc composition defaults to 33 decibels below the volume level of the selected audio file.

A user may also be able to modify eposc composition use, matched to their personal preferences, for storage within Tone Generator 703. For example, a user may determine one or more eposc compositions for playback during at least some portion of a selected audio file. The user may also select individual volume levels for each component frequency as well as an overall volume level for the entire eposc composition.

A user may be able to store a new eposc composition with Tone Generator 703 or through an externally connectable storage device such as a USB Drive consisting of flash or some other form of memory.

Audio receiver 706 is coupled to Tone Generator 703 by either input signal 704 or input signal 705. Hence, audio receiver 706 is capable of receiving one or more audio signals from Tone Generator 703. Tone Generator's 703 outputs audio signals 704, 705 to audio receiver 706. In this example, signal 704 contains the original audio signal 702 received by Tone Generator 703 from player 701. Signal 704 may be unaltered and passed through Tone Generator 703. Signal 704 may be either a digital or an analog signal or alternatively, audio signal 704 may have undergone a D-to-A or an A-to-D process depending on the type of originating signal 702. For example, audio signal 702 may originate from player 701 as an analog signal. Tone Generator 703 converts the signal to digital, hence, signal 704 is embodied in both digital and analog form.

Audio receiver 706 may also receive signal 705 from Tone Generator 703. In one embodiment, signal 705 may contain the actual eposc compositions generated from Tone Generator 703. Such signals are time stamped so that the playback of each signal is synchronized with the audio content from audio signal 704. Alternatively, signals 704 and 705 may be combined into a single audio signal such that the audio content from Audio Player 701 and eposc composition generated from Tone Generator 703 are combined into a single signal. Signal 705 may be either an analog or a digital.

Once signals 704 and 705 are received from receiver 706, the signals are combined (unless they came as a single signal to begin with) and passed to speakers 708 along signal path 707. In the illustrated embodiment, signal path 707 is 12 gauge oxygen free copper wire capable of transmitting an analog signal to analog speakers 708. However, path 707 may be embodied in any transmission medium capable of sending a digital signal to digital speakers (not shown).

Receiver 706 is configured for converting incoming signals 704 and 705 to a single analog signal and then amplifying the signal through built-in amplifier 709 before passing the signal to speakers 708. If the incoming signals 704 and 705 are already in analog form, then a D-to-A conversion is not required and the two signals are simply mixed into a single signal and amplified by amplifier 709 before passing to speakers 708.

Figure 8:
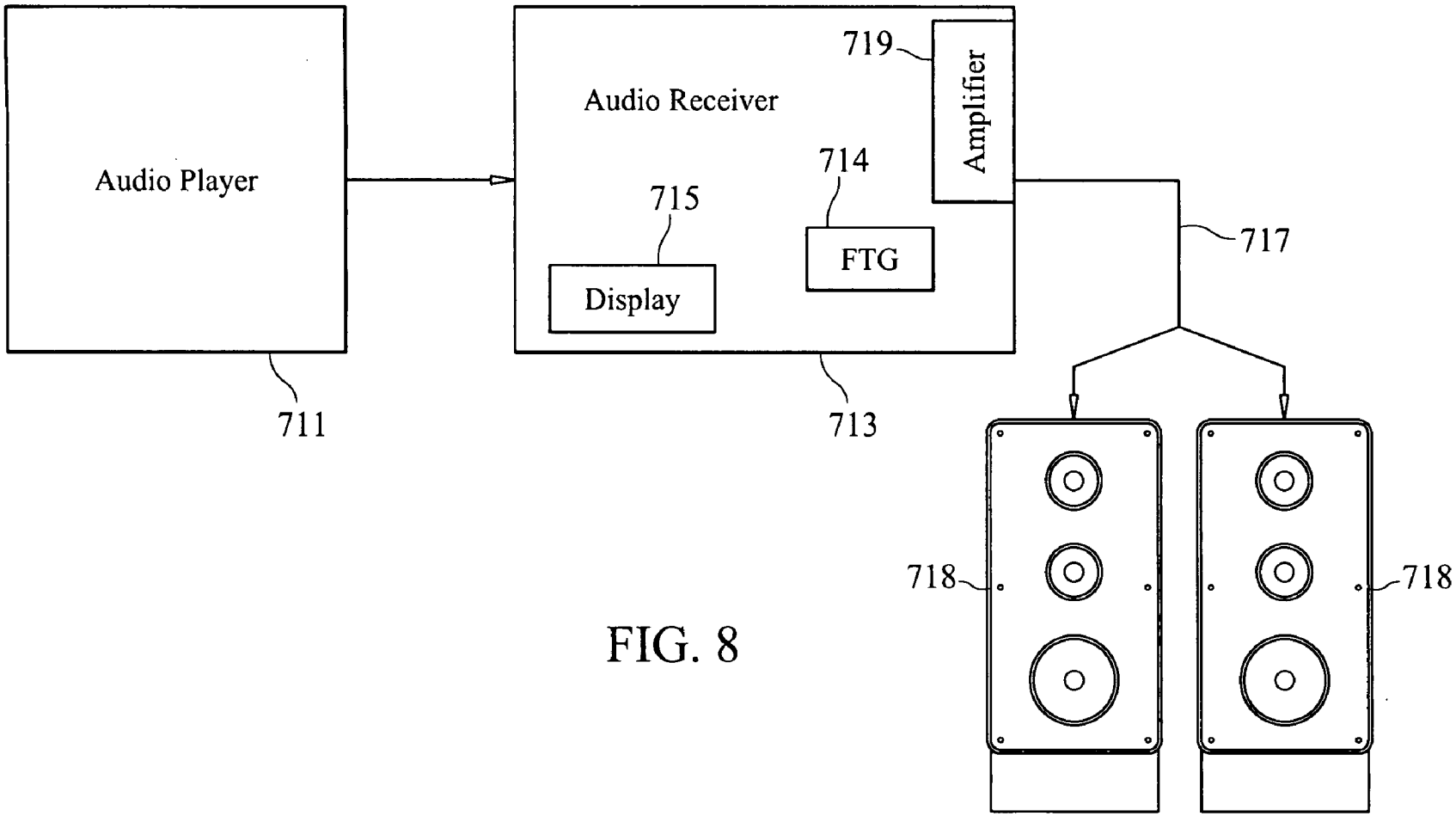
FIG. 8 illustrates another embodiment of a hardware device capable of generating ultrasonic and infrasonic component frequencies to be played concurrently with audible content.

FIG. 8 illustrates another embodiment of a hardware device capable of generating an eposc composition to be played concurrently with audible content. Audio system 720 comprises an audio player 711, an audio receiver 713 and a pair of speakers 718. Audio player 711 is a device configured for reading digital or analog audio content from a readable storage medium such as a CD, DVD, vinyl record, or a digital audio file such as an MP3 or .WAV file. Upon playback of an audio signal, player 711 transmits audio signal 712 to audio receiver 713. Audio signal 712 is a digital audio signal transmitted from player 711 which itself is a digital device, an analog signal that may undergo a digital-to-analog conversion within player 711 or an analog signal that does not require a D-to-A conversion since player 711 is an analog device such as a vinyl record player. Receiver 713 may receive signal 712 from player 711 over a wireless network.

Audio receiver 713 comprises a built in Frequency Tone Generator 714, display 715 and amplifier 719. Receiver 713, which is coupled to audio player 711, is capable of receiving signal 712 in either an analog or digital format. Typically, receiver 713 comprises separate audio inputs for both analog and digital signals. Receiver 713 also has a Tone Generator 714 which generates component tones and, therefore, eposc compositions. Tone Generator 714 may be coupled to amplifier 719, thereby allowing for the eposc compositions to be amplified before transmission outside receiver 713. Receiver 713 also contains display 715 which may present a user with a menu system of differing predefined eposc compositions that may be selected. Selections from the menu system are accomplished by manipulating buttons coupled to display 715. Display 715 may be a touch screen allowing manipulation of the menu items by touching the display itself.

Alternatively, receiver 713 may have a touch screen, a plurality of knobs or a number of buttons that are configured to allow a user to select predefined categories of eposc compositions that are cross-referenced to sensory effects for playback during audio content. For example, display 715 may include a menu offering 35 different eposc compositions. Through manipulation of the display's touch screen and/or buttons, a user may choose one or more eposc compositions to be generated during playback of the audio content. In another example, Sensory Effect 7 may be entitled "SE007." Sensory Effect 7 may be cross-referenced to a category of component frequencies such as 1.1 Hz, 1.78 Hz, 2.88 Hz, and 23,593 Hz. Therefore, if a user selects "SE007", the above eposc compositional frequencies will be generated and played concurrently with the audio content received from audio player 711.

Receiver 713 may further include a database that stores a matrix of the eposc compositions that correspond to particular sensory effects. This database may be stored within Tone Generator 714 or external to it—yet nonetheless stored within receiver 713. A user may be able to create his own sensory effects for storage within Tone Generator 703, as well as the ability to alter the existing eposc compositions. Moreover, a user may be able to edit the volume level of each eposc composition so that the presence of an eposc composition during playback of audio content may be stronger or lower than at a predetermined volume level.

All the signals generated from within receiver 713, as well as signals received by audio signal 712, pass through amplifier 719 to amplify the signal. The audio signal is then transmitted along signal path 717 to speakers 718. In the illustrated embodiment of FIG. 8, signal path 717 are 12 gauge oxygen free copper wires capable of transmitting an analog signal. Signal path 717 may also be embodied in a transmission medium capable of transmitting a digital signal to speakers 718. In another embodiment, signal 717 is a wireless transmission capable of transmitting digital or analog audio signals to speakers 718.

Figure 9:
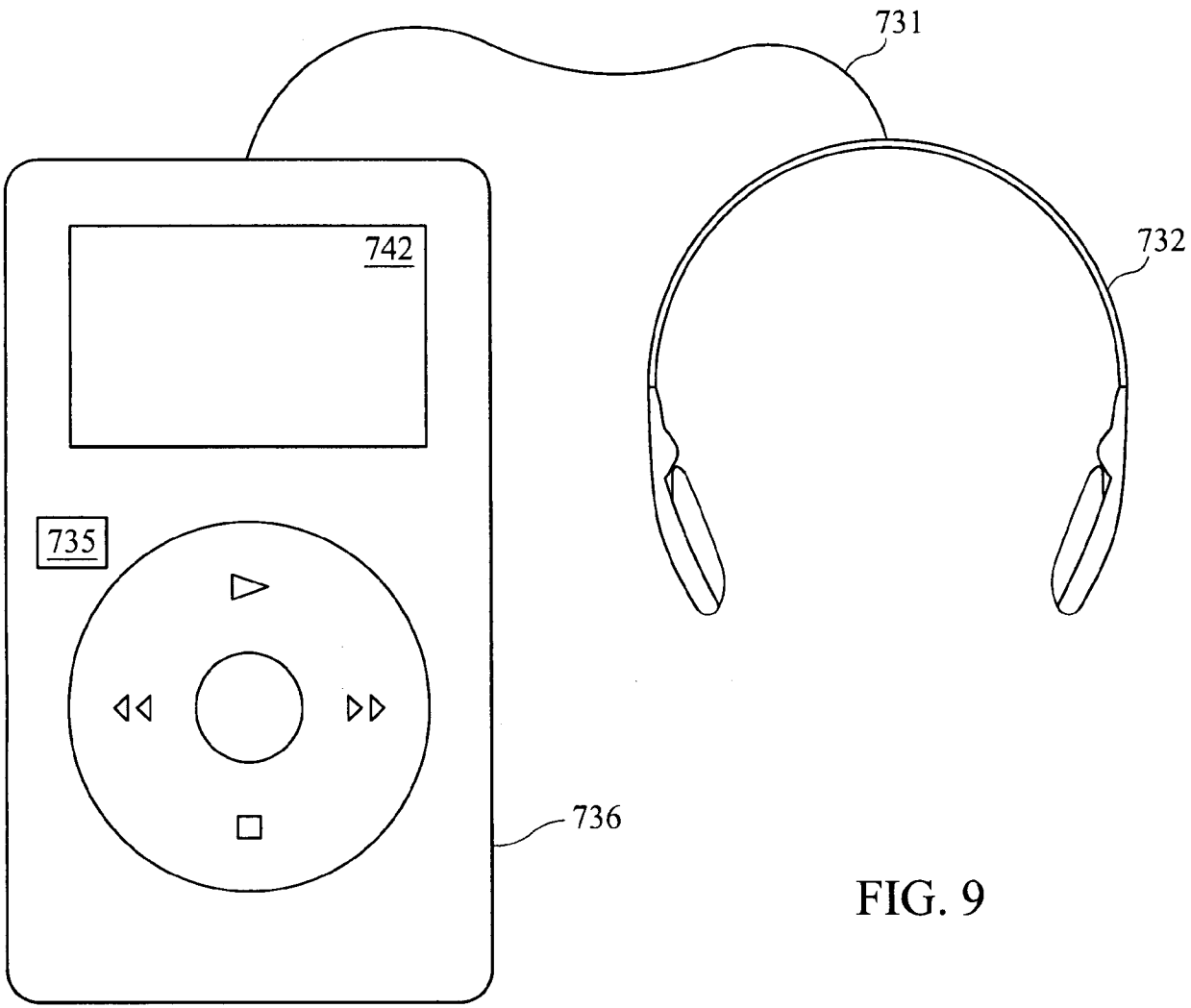
FIG. 9 illustrates another embodiment of a hardware device capable of generating ultrasonic and infrasonic component frequencies to be played concurrently with audible content.

FIG. 9 illustrates another embodiment of a device capable of generating eposc compositions that may be played concurrently with audible content. Audio system 730 comprises Portable Music Player 736 and a pair of headphones 732. Music Player 736 is typically a self contained audio device capable of storing, playing and outputting digital audio signals. Music Player 736 has an internal storage system such as a hard drive or non-volatile flash memory capable of storing one or more digital audio files. Music Player 736 also comprises a digital-to-analog converter to convert digital audio stored within the device into analog audio signals that may be outputted from the device through wire 731 into headphones 732. Music Player 736 may also have an internal amplifier capable of amplifying an audio signal before exiting the device. Music Player 736 also comprises one or more buttons 741 to manipulate the device. Graphical display 742 provides visual feedback of device information to a user.

In the illustrated embodiment, Frequency Tone Generator 735 is an internal processor within Music Player 736 capable of generating eposc compositions. The functionality of Tone Generator 735 is substantially the same as Tone Generator 714 illustrated and described with reference to FIG. 8. Further, graphical display 742 is capable of providing a user with one or more menu options for predefined categories or eposc compositions of frequencies, similar to display 715 shown in FIG. 7.

Figure 10:
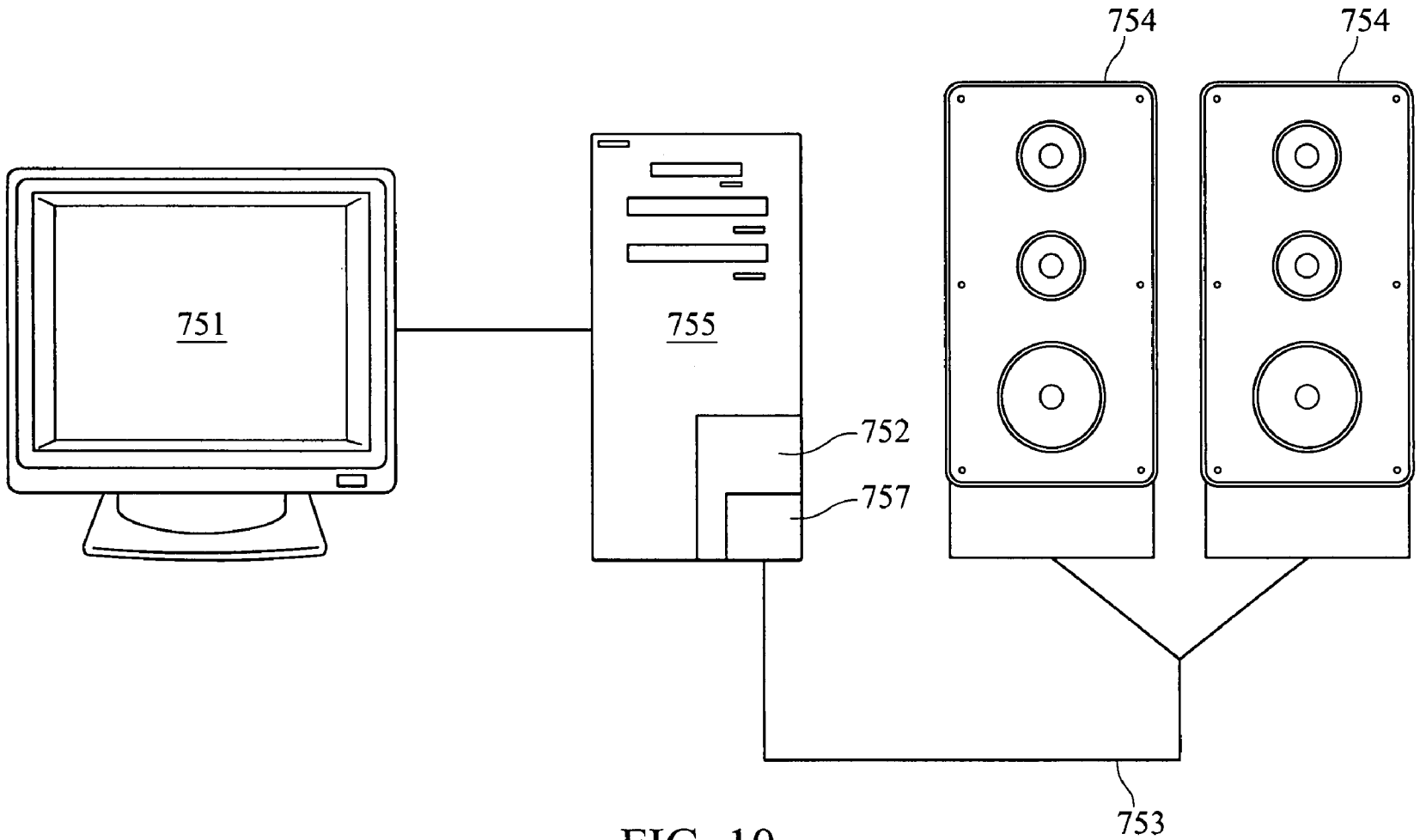
FIG. 10 illustrates another embodiment of a hardware device capable of generating ultrasonic and infrasonic component frequencies to be played concurrently with audible content.

FIG. 10 illustrates another embodiment of a hardware device capable of generating eposc compositions to be played concurrently with audible content. System 750 comprises computer 755, display 751 and speakers 754. Display 751 is coupled to computer 755, which is capable of transmitting a graphical signal to display 751. Computer 755 may be any type of computer including a laptop, personal computer hand held or any other computing system. Computer 755 further comprises internal soundcard 752, which may be external to computer 752, yet capable of sending and receiving signals through a transmission medium such as USB, FireWire or any other wired or wireless transmission medium. Soundcard 752 is capable of processing digital or analog audio signals and outputting the signals along path 753 to speakers 754. In another embodiment, soundcard 752 may wirelessly transmit audio signals to speakers 754.

Soundcard 752 also comprises Frequency Tone Generator 757 whose function is to generate eposc compositions. Tone Generator 757 may be a separate processor directly hardwired to soundcard 752. Alternatively, no specific processor is required, but rather the existing processing capability of soundcard 752 is capable of generating frequencies solely through software. It may be that an external device is coupled to soundcard 752 that allows for tone generation. The functionality of Tone Generator 757 is substantially the same as described above in regards to Tone Generator 714 illustrated in FIG. 7. A software application may permit manipulation of Tone Generator 757 through graphical menu options. For example, a user may be able to add, remove or edit eposc compositions.

A user may choose to add an eposc composition (as generated by the methods described herein) to a number of different types of digital media including music stored in digital files or residing on optical discs playing through an optical disc drive; to video content, computer-generated animation and still images functioning as slide shows on a computer. An example of adding an eposc composition to still images can entail the creation of a slideshow of still images with or without music and adding an eposc composition, or in similar fashion to a movie or video originally shot without sound. For example, the eposc composition may be mixed with ambient sound and is concurrently played alongside the slideshow of images and its audible content, if present, or alongside the silent movie. Such an eposc composition may also be stored as part of the slideshow, such that each time the slideshow is replayed, the eposc composition is automatically loaded and concurrently played.

In another embodiment, a user may add an eposc composition—while playing computer games. Current game developers spend large amounts of time and money to add audio content to enhance the sensory immersion of a user into the game. The goal of a game developer is make the user feel as if he is not playing a game, but rather is part of an alternate reality. The visual content is only a part of the sensory content. The audio portion is equally important to engage a user into a game. Adding an eposc composition or a plurality of eposc compositions has the potential to increase the level of sensory immersion a user experiences with a computer game. As described above, the added eposc composition can enhance the perception of the audio content of the game. The added eposc composition may be generated on the fly, and concurrently played with the audio content of the game. Through software external to a game, a user may also have control over the eposc composition he wants to include during game play.

Profiles may also be created for specific games so that a user may create an eposc composition for a specific game. For example, game X may be a high intensity first-person-prospective shooting game with powerful music and sound effects meant to invoke strong emotions from the user. A user may choose to add one or more specific eposc compositions for concurrent playback with the game that may further enhance the sensory perception of the overall media content and its visceral and emotional effects. Such a profile could then be saved for game X. Hence, upon launching game X, external software would become aware of game X's launch, load the predefined profile of eposc compositions and begin generation of an eposc composition, followed by another eposc composition as the game progresses.

A game developer may choose to add in his own eposc composition as part of the audio content of the game. A developer would have unlimited control over the type of content to include. For example, a specific portion of a game may elicit specific sensory effects while other portion may elicit different sensory effects. A developer could custom-tailor the eposc compositions for each part of a game, in the same way a movie producer may do so for different scenes. A game developer may also choose to allow a user to turn off or edit the added eposc compositions. Hence, a user may be able to choose his own eposc composition profiles for each portion of a game, much like adding profiles for each game as described above, except each profile could be stored as part of the actual game.

Gaming consoles may also implement internal or external processing capability to generate eposc compositions for concurrent playback with games. A gaming console is a standalone unit, much like a computer, that comprises one or more computing processors, memory, a graphics processor, an audio processor and an optical drive for loading games into memory. A gaming console may also include a hard disc for permanently storing content. Examples of gaming consoles include the Xbox 360 by Microsoft Corporation and the PlayStation 2 by Sony Corporation.

As described above in regards to computer 755, a gaming console may contain a tone generator allowing for the concurrent playback of eposc compositions with sound content of a game. Users may have the capability to set up profiles or eposc compositions for individual games or game segments. Game developers may also create-profiles for certain parts of a game as well, such that different portions of a game may elicit different sensory responses from a user.

Another type of gaming console is a portable gaming console. Such a console is often handheld and runs off portable battery power. An example of a portable gaming console would be the PSP by Sony, Inc. Such a portable console may also incorporate the same tone generation capabilities as described above. Due to the portability of such a console, headphones are often used as a source of audio output. In most cases, headphones do not have the capability to reproduce the full dynamics of the infrasound and ultrasound portions of the eposc compositions, but they transmit the derivative tonal characteristics of the eposc compositions as the means to enhance sensory perception.

Other types of hardware equipment are capable of including tone generator capabilities as described above. Examples include but are not limited to, personal digital assistants ("PDA"), cell phones, televisions, satellite TV receivers, cable TV receivers, satellite radio receivers such as those made by XM Radio and Sirius Radio, car stereos, digital cameras and digital camcorders. As in the case of headphones used for gaming, speakers and headsets used for mobile media devices or cell phones do not have the capability to transmit the full dynamics of the infrasonic and ultrasonic portions of the eposc compositions, but they-transmit the derivative properties, such as the tonal characteristics of the eposc compositions, as the means to enhance sensory perception.

Another embodiment using tone generators are media transmissions systems, whereby the eposc compositions could be incorporated into the media content stream. Terrestrial and satellite transmitted media streams such as television and radio could benefit from enhanced perception of sensory content, as well as internet and cell phone transmissions.

Most of the apparatuses that have been described include personal entertainment devices usually limited to use within a user's home, car or office, with the exceptions whereby the epocs compositions are streamed with transmitted content. Numerous other venues may be used to for playback of eposc compositions concurrently with other media content. In one embodiment, any venue where music is played may incorporate eposc composition playback such as live concert halls, indoor and outdoor sports arenas for use during both sporting events and concerts, retail stores, coffee shops, dance clubs, theme parks, cruise ships, bars, restaurants and hotels. Many of the above referenced venues play background audible content which could benefit from the concurrent playback of eposc compositions to enhance the perception of the sensory content of media played and displayed in the space. Venues such as hospitals or dentists office could concurrently playback music along with eposc compositions in order to provide a more conducive setting for their procedures.

Another venue that may benefit from eposc compositions is a movie theater. Much like video games, a producer aims to transport an audience away from day-to-day reality and into the movie's reality. Some producers and directors have inferred that the visual content may comprise only 50% of the movie experience. The balance of the movie experience primarily comes from audible content. Movie producers may implement eposc compositions into some or all portions of a movie in order to create more sensory engagement with the product. In a manner similar to choosing music for different parts of a movie, the producer could also choose various combinations and sequences of eposc compositions to enhance the audience's perception of the sensory content. In one embodiment, the eposc compositions may be added into the audio tracks of the movie. In another embodiment, a separate audio track may be included which only contains the eposc compositions. As movies evolve from film print to digital distribution, adding or changing eposc compositions mid-way through a theatrical release is easier for the producer. In another embodiment, the finished movie may not contain any eposc compositions. Instead such eposc compositions may be added during screening using external equipment controlled by individual movie theaters.

The producer may also provide alternate sound and eposc composition tracks for distribution through video, DVD or HD-DVD. This would allow the viewer to choose to include or not include eposc compositions during playback of the movie.

Whereas many alterations and modifications of the present invention will no doubt become apparent to a person of ordinary skill in the art after having read the foregoing description, it is to be understood that any particular embodiment shown and described by way of illustration is in no way intended to be considered limiting. Therefore, references to details of various embodiments are not intended to limit the scope of the claims which in themselves recite only those features regarded as the invention.

What is claimed is:

1. A method for creating a first composition and a second composition, said method comprising:

selecting a root frequency;

calculating a first component frequency from said root frequency, said first component frequency having a frequency residing within a group consisting of an ultrasonic frequency and an infrasonic frequency;

calculating a second component frequency from said first component frequency, said second component frequency having a frequency residing within a group consisting of an ultrasonic frequency and an infrasonic frequency;

calculating a third component frequency from at least said second component frequency, said third component frequency having a frequency residing within a group consisting of an ultrasonic frequency and an infrasonic frequency;

generating a first composition by encoding said first component frequency and said second component frequency into a format configured for storing said first composition in a first storage location; and generating a second composition by combining said first composition with said third component frequency and encoding said second composition into a format configured for storing said second composition in a second storage location.

2. The method of claim 1 further comprising:

calculating a fourth component frequency from at least said third component frequency, said fourth component frequency having a frequency residing within a group consisting of an ultrasonic frequency and an infrasonic frequency; and generating a third composition by combining said second composition with said fourth component frequency and encoding said third composition into a format configured for storing said third composition in a third storage location.

3. The method of claim 1, wherein said root frequency is a primary root frequency of 144 MHz.

4. The method of claim 1 wherein said root frequency is a secondary root frequency selected from a range of 0.1 MHz to 287 MHz.

5. The method of claim 1, wherein said root frequency is a tertiary root frequency selected from a range of 1.5 kHz to 10 PHz.

6. The method of claim 1 further comprising: retrieving said first composition from said first storage location; and encoding said first composition into a media.

7. The method of claim 6, wherein said media is selected from a group consisting of audio, audio/visual, streaming Internet transmission, radio transmission, satellite television transmission, cable television transmission, game audio, game audio/visual, computer audio, computer audio/visual, advertising and telecommunications.

8. The method of claim 7, wherein said media is digitally encoded.

9. The method of claim 6, wherein said media content is selected from a group consisting of voice, sounds, images, music, movies, games, television shows and Internet generated and published content.

10. The method of claim 6, wherein said media includes a media device.

11. The method of claim 10, wherein said media device is selected from a group consisting of a microprocessor, television, sound system, public address system, computer, game box, cell phone, PDA and .mp3 player.

12. The method of claim 6, wherein said media includes a media storage format.

13. The method of claim 12, wherein said media storage format is digital.

14. The method of claim 12, wherein said media storage format is selected from a group consisting of a CD, DVD, optical based storage format, memory chip, memory stick and memory card.

15. The method of claim 2 further comprising: retrieving said third composition from said third storage location; and encoding said third composition into a media.

16. The method of claim 1 wherein said second component frequency is subtracted from said first component frequency and said step of generating a first composition comprises encoding said first component frequency a into a format configured for storing said first composition in a first storage location.

17. The method of claim 1, wherein said third component frequency is differing in the type of frequency as said first and second component frequency.

18. A method for creating a media having at least a first composition and a second composition, said method comprising:

selecting a root frequency;

calculating a first component frequency from said root frequency, said first component frequency having a frequency residing within a group consisting of an ultrasonic frequency and an infrasonic frequency;

calculating a second component frequency from said first component frequency, said second component frequency having a frequency residing within a group consisting of an ultrasonic frequency and an infrasonic frequency;

calculating a third component frequency from at least said second component frequency, said third component frequency having a frequency residing within a group consisting of an ultrasonic frequency and an infrasonic frequency;

generating a first composition by encoding said first component frequency and said second component frequency into a format configured for storing said first composition in a first storage location; and generating a second composition by combining said first composition with said third component frequency and encoding said second composition into a format configured for storing said second composition in a second storage location;

retrieving said second composition from said second storage location;

encoding said second composition into a media;

retrieving said first composition from said first storage location; and encoding said first composition into a media.

19. A method of enhancing a sensory perception of media content, comprising:

receiving a first media file having audible content and storing said first media file in a first storage location;

generating a first composition by, selecting a root frequency, calculating a first component frequency from said root frequency, said first component frequency having a frequency residing within a group consisting of an ultrasonic frequency and an infrasonic frequency, calculating a second component frequency from said first component frequency, said second component frequency having a frequency residing within a group consisting of an ultrasonic frequency and an infrasonic frequency, encoding said first component frequency and said second component frequency into a format configured for storing said first composition in a first storage location, storing said first composition in a second storage location;

generating a second composition by, calculating a third component frequency from said second component frequency, said third component frequency having a frequency residing within a group consisting of an ultrasonic frequency and an infrasonic frequency, encoding said third component frequency and said first composition into a format configured for storing said second composition in a third storage location, storing said second composition in a third storage location;

creating a combined media file configured for retrieval and playback of said first composition and said first media file by, retrieving said first media file from said first storage location, retrieving said first composition from said second storage location, combining said first composition with said first media file and encoding said first composition into a format configured for storing said combined media file; and storing said combined media file.

20. The method of claim 19, wherein the first storage location is a computer memory.

21. The method of claim 20, wherein the second storage location is a computer memory.

22. The method of claim 19, wherein the first storage location is a hard disc.

23. The method of claim 22, wherein the second storage location is a hard disc.

24. The method of claim 19, wherein generating said first composition is generated using a tone generator.

25. The method of claim 19, wherein generating said first composition is generated using a computing system.

26. The method of claim 19, wherein said combined audio file comprises multiple audio channels.

27. The method of claim 19, wherein said combined audio file comprises multi-channel audio content from a movie.

28. The method of claim 19, wherein the combined audio file comprises audio content for a video game.

29. The method of claim 19, further comprising determining a volume level of said first composition, wherein said volume level of said first composition is in reference to a volume level of said first audio file.

30. The method of claim 29, wherein determining said volume level of said first composition further comprises determining a volume level of each frequency within said first composition, such that the volume level of each frequency is independent of each other.

31. A method of enhancing a sensory perception of audio content, comprising:

providing a user with a plurality of compositions, each composition having at least two component frequencies, said component frequencies having a frequency residing within a group consisting of an ultrasonic frequency and an infrasonic frequency;

receiving a first media file from the user and storing it in a first storage location, said media file containing an amount of audible content;

receiving a request for a first and second composition from the user, said first and second composition being selected from said plurality of compositions;

generating said first composition with a tone generating device by, selecting a root frequency, calculating a first component frequency from said root frequency, said first component frequency having a frequency residing within a group consisting of an ultrasonic frequency and an infrasonic frequency, calculating a second component frequency from said first component frequency, said second component frequency having a frequency residing within a group consisting of an ultrasonic frequency and an infrasonic frequency, encoding said first component frequency and said second component frequency into a format configured for storing said first composition in a first storage location, storing said first composition in a second storage location;

generating said second composition with a tone generating device by calculating a third component frequency from said second component frequency, said third component frequency having a frequency residing within a group consisting of an ultrasonic frequency and an infrasonic frequency, encoding said third component frequency and said first composition into a format configured for storing said second composition in a first storage location, storing said second composition in a second storage location; and playing at least a portion of said first composition and said first audio file.

32. The method of claim 31, further comprising allowing the user to control a volume level of the first composition, wherein said volume level of the first composition is in reference to a volume level of the first audio file.

33. The method of claim 31, further comprising allowing the user to edit the first composition by editing individual frequencies and volume levels of the first composition.

34. A machine readable storage medium comprising:

a media file having an amount of audible content;

a first composition of at least two of an infrasonic and ultrasonic frequency, said composition having at least two component frequencies, said component frequencies having a frequency residing within a group consisting of an ultrasonic frequency and an infrasonic frequency, said first composition combined with said media file such that playing said media file results in a playback of at least a portion of said first composition and said media file; and a second composition of at least said first composition and a third component frequency, said third component frequency having a frequency residing within a group consisting of an ultrasonic frequency and an infrasonic frequency, said second composition combined with said media file such that playing said media file results in a playback of at least a portion of said second composition and said media file.

35. The medium of claim 34, wherein said media file is an audio file.

36. The medium of claim 34, wherein said media file is an audio/visual file.

* * * * *